US008512047B2

(12) United States Patent
Li

(10) Patent No.: US 8,512,047 B2
(45) Date of Patent: Aug. 20, 2013

(54) ROTATABLE COAXIAL ADAPTOR FOR LINKING HIGH FREQUENCY COAXIAL CABLES

(76) Inventor: Chin-Lai Li, New Taipei (TW)

( * ) Notice: Subject to any disclaimer, the term of this patent is extended or adjusted under 35 U.S.C. 154(b) by 31 days.

(21) Appl. No.: 13/417,941

(22) Filed: Mar. 12, 2012

(65) Prior Publication Data

US 2012/0322275 A1 Dec. 20, 2012

(30) Foreign Application Priority Data

Jun. 16, 2011 (TW) ..... 100210856 U

(51) Int. Cl.
*H01R 39/00* (2006.01)

(52) U.S. Cl.
USPC ..... 439/20

(58) Field of Classification Search
USPC ..... 439/20, 21, 578
See application file for complete search history.

(56) References Cited

U.S. PATENT DOCUMENTS 4,022,518 A * 5/1977 Gattaz ..... 439/28
5,122,063 A * 6/1992 Cooper ..... 439/13
5,277,590 A * 1/1994 Thomas et al. ..... 439/20
6,817,899 B1 * 11/2004 Zerebilov ..... 439/582
7,175,466 B2 * 2/2007 Feinweber et al. ..... 439/357
7,207,844 B2 * 4/2007 Peng ..... 439/640
7,374,427 B2 * 5/2008 Kodaira et al. ..... 439/63
7,399,209 B2 * 7/2008 Kodaira ..... 439/640
7,766,659 B2 * 8/2010 Otsu et al. ..... 439/11
2006/0211303 A1 * 9/2006 Kodaira et al. ..... 439/579
2009/0186491 A1 * 7/2009 Otsu et al. ..... 439/11
2012/0322275 A1 * 12/2012 Li ..... 439/13

* cited by examiner

*Primary Examiner* — Ross Gushi
(74) *Attorney, Agent, or Firm* — William E. Pelton; Cooper & Dunham LLP

(57) ABSTRACT

A rotatable coaxial adaptor for linking high frequency coaxial cables has a first mounting block, a first bearing, a first rotary part, a connecting sleeve, a second bearing and a second mounting block. The first bearing and the first rotary part are mounted in the first mounting block and the first rotary part has a first joining tube connected to a coaxial cable. The connecting sleeve is secured to the first mounting block. The second bearing is mounted around the connecting sleeve. The second mounting block with a second joining tube connected to another coaxial cable is mounted around the second bearing and the connecting sleeve. With the structure mentioned above, the coaxial cables will not be driven to bend when devices connected to the coaxial cables are moved. Therefore, the coaxial cables can be protected from damage.

20 Claims, 4 Drawing Sheets

ROTATABLE COAXIAL ADAPTOR FOR LINKING HIGH FREQUENCY COAXIAL CABLES

BACKGROUND OF THE INVENTION

1. Field of the Invention

The present invention relates to a rotatable coaxial adaptor, and more particularly to a rotatable coaxial adaptor for linking high frequency coaxial cables that protects coaxial cables from bending damage.

2. Description of the Prior Arts

A coaxial cable is a type of transmission line which is connected between electronic devices for carrying radio frequency (RF) signals. Two ends of the coaxial cable terminate with coaxial connectors and the coaxial connectors are fastened to the devices.

However, the coaxial connectors cannot rotate or move relative to the devices after being fastened to the devices. When the devices connected to the coaxial connectors are moved, the coaxial cable will be driven to bend and that causes the coaxial cable to be damaged and reduce the lifespan thereof.

To overcome the shortcomings, the present invention provides a rotatable coaxial adaptor for linking high frequency coaxial cables to mitigate or obviate the aforementioned problems.

SUMMARY OF THE INVENTION

The main object of the present invention is to provide a rotatable coaxial adaptor for linking high frequency coaxial cables that protects coaxial cables from bending damage.

To achieve the foregoing objective, the rotatable coaxial adaptor for linking high frequency coaxial cables in accordance with the present invention comprises a first mounting block, a first stationary insulator, a first stationary contact pin, a first bearing, a first rotary part, a first rotary contact pin, a connecting sleeve, a second stationary insulator, a second stationary contact pin, a second bearing, a second mounting block, a second rotary part and a second rotary contact pin. The first stationary insulator and the first bearing are mounted in the first mounting block. The first stationary contact pin is mounted through the first stationary insulator. The first rotary part is mounted through the first bearing and has a first rotary insulator and a first joining tube. The first joining tube is connected to a coaxial cable. The first rotary contact pin is mounted through the first rotary insulator. The connecting sleeve is secured to the first mounting block. The second stationary insulator is mounted in the connecting sleeve. The second stationary contact pin is mounted through the second stationary insulator. The second bearing is mounted around the connecting sleeve. The second mounting block is mounted around the second bearing and the connecting sleeve and has a second joining tube connected to another coaxial cable. The second rotary part has a second rotary insulator mounted in the second mounting block. The second rotary contact pin is mounted through the second rotary insulator. With the structure mentioned above, the coaxial cables will not be driven to bend when devices connected to the coaxial cables are moved. Therefore, the coaxial cables can be protected from damage.

Other objectives, advantages and innovative features of the invention will become more apparent from the following detailed description with the drawings attached.

DETAILED DESCRIPTION OF THE PREFERRED IMPLEMENTATION

Figure 1:
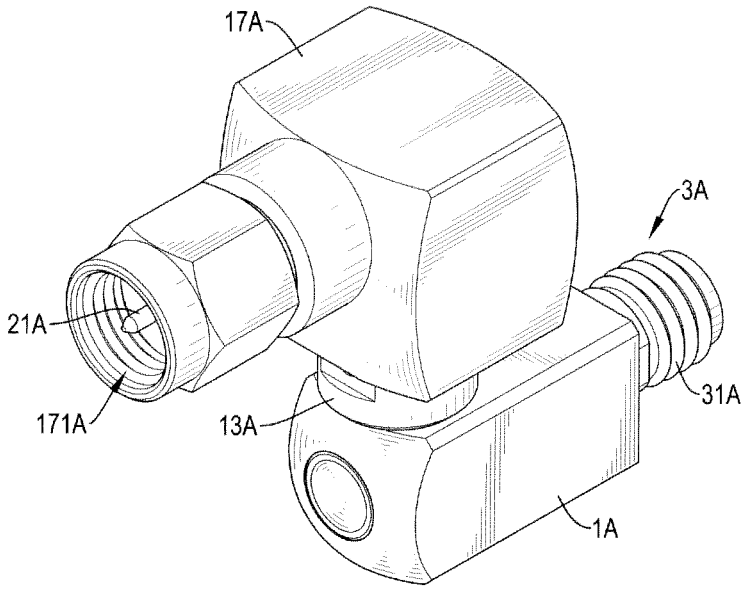
FIG. 1 is a perspective view of a rotatable coaxial adaptor for linking high frequency coaxial cables in accordance with the present invention.
Figure 4:
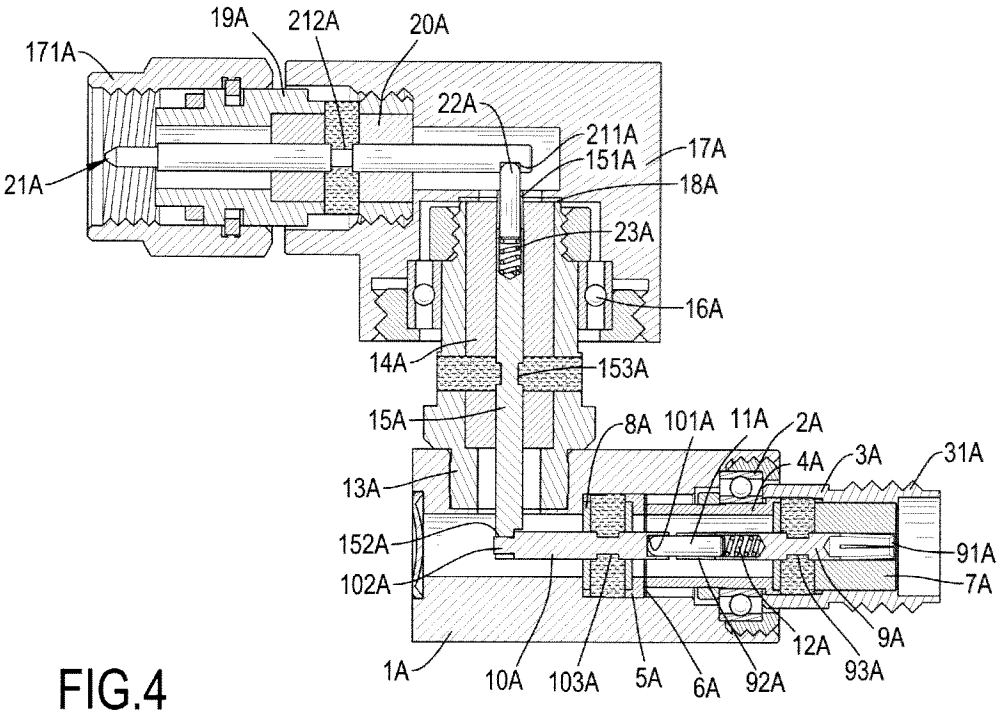
FIG. 4 is a side view in partial section of the rotatable coaxial adaptor in FIG. 1.

With reference to FIGS. 1 and 4, a rotatable coaxial adaptor for linking high frequency coaxial cables in accordance with the present invention comprises a first assembly and a second assembly. The first assembly includes a first mounting block 1A, a first stationary part, a first stationary contact pin 10A, a first bearing 2A, a first rotary part, a first rotary contact pin 9A, a first linking pin 11A and a first spring 12A. The second assembly is connected to the first assembly and includes a second stationary part, a second bearing 16A, a second mounting block 17A, a second rotary part, a second rotary contact pin 21A, a second linking pin 22A and a second spring 23A.

Figure 2:
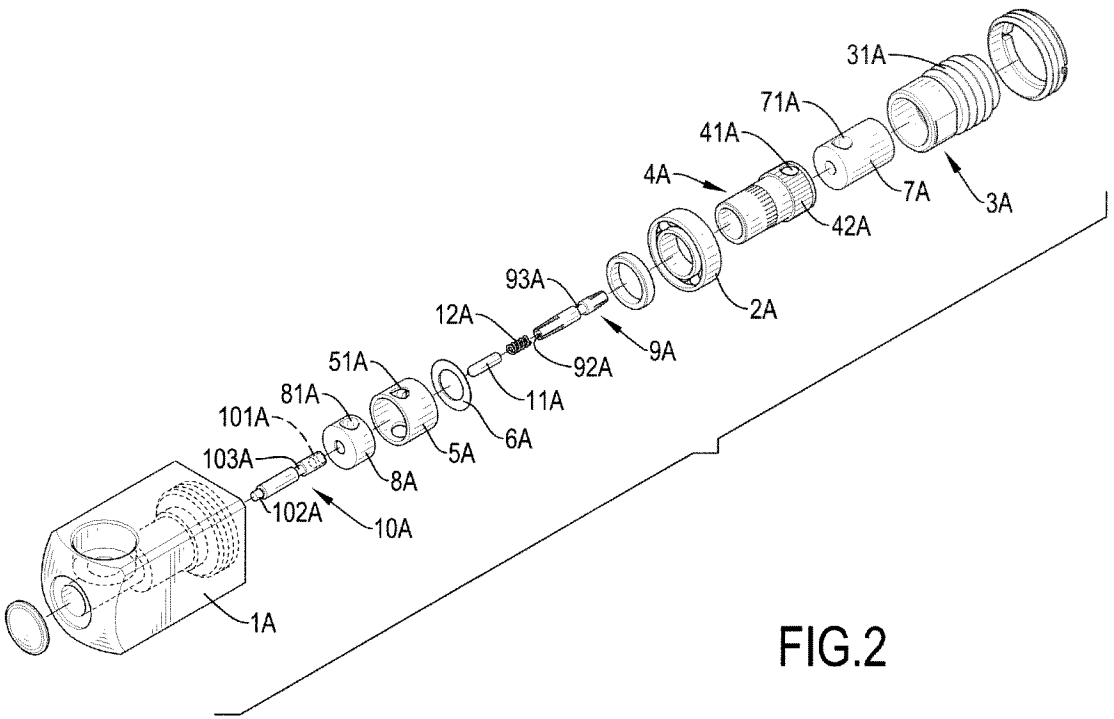
FIG. 2 is an exploded perspective view of a first assembly of the rotatable coaxial adaptor in FIG. 1.

With reference to FIGS. 2 and 4, the first mounting block 1A has a first receiving space, a top surface and a top opening. The first receiving space is formed inside the first mounting block 1A and has an open rear. The top opening is formed in the top surface of the first mounting block 1A and communicates with the first receiving space.

The first stationary part is mounted in the first mounting block 1A and has a stationary sleeve 5A and a first stationary insulator 8A. The stationary sleeve 5A with an annular sidewall and two pouring holes 51A is disposed in the first receiving space of the first mounting block 1A. The pouring holes 51A are respectively formed through the annual sidewall of the stationary sleeve 5A. The first stationary insulator 8A with annular sidewall and two pouring holes 81A is mounted in the stationary sleeve 5A. The pouring holes 81A are respectively formed through the annual sidewall of the first stationary insulator 8A and align with the pouring holes 51A of the stationary sleeve 5A.

The first stationary contact pin 10A which has a front end surface, a rear end surface, an annular surface, a guide recess 101A, an inserting rod 102A and an annular groove 103A is made of an electrically conductive material and is mounted through the first stationary insulator 8A. The guide recess 101A is formed in the rear end surface of the first stationary contact pin 10A. The inserting rod 102A extends from the front end surface of the first stationary contact pin 10A. The annular groove 103A communicating with the pouring holes 81A of the first stationary insulator 8A is formed in the annular surface of the first stationary contact pin 10A.

The first bearing 2A is mounted in the first receiving space of the first mounting block 1A. The first rotary part is rotatably mounted through the first bearing 2A so that the first rotary part can rotate relative to the mounting block 1A. The first rotary part has a first rotary sleeve 4A, a first joining tube 3A and a first rotary insulator 7A. The first rotary sleeve 4A rotatably mounted through the first bearing 2A is disposed in the first receiving space of the first mounting block 1A and is positioned in back of the stationary sleeve 5A. A first wave spring 6A is mounted between the first rotary sleeve 4A and the stationary sleeve 5A for reducing friction damage during rotation of the first rotary sleeve 4A relative to the stationary sleeve 5A. The first rotary sleeve 4A has an annular sidewall, a rear end, two pouring holes 41A and an embossed surface 42A. The pouring holes 41A are respectively formed through the annual sidewall of the first rotary sleeve 4A. The embossed surface 42A is formed around the rear end of the first rotary sleeve 4A.

The first joining tube 3A with a rear end and a connecting section 31A is secured around the embossed surface 42A of the first rotary sleeve 4A. The connecting section 31A is formed on the rear end of the first joining tube 3A and protrudes out of the open rear of the first receiving space of the first mounting block 1A. The first rotary insulator 7A with an annular sidewall and two pouring holes 71A is mounted through the first rotary sleeve 4A and the first joining tube 3A. The pouring holes 71A are respectively formed through the annual sidewall of the first rotary insulator 7A and align with the pouring holes 41A of the first rotary sleeve 4A.

The first rotary contact pin 9A with a front end surface, a rear end surface, an annular surface, a contact recess 91A, a guide recess 92A and an annular groove 93A is made of an electrically conductive material, is mounted through the first rotary insulator 7A and is rotatably connected to the first stationary contact pin 10A. The contact recess 91A is formed in the rear end surface of the first rotary contact pin 9A. The guide recess 92A is formed in the front end surface of the first rotary contact pin 9A. The annular groove 93A is formed in the annular surface of the first rotary contact pin 9A and communicates with the pouring holes 71A of the first rotary insulator 7A.

The first linking pin 11A is made of an electrically conductive material and has a rear end and a front end respectively mounted in the guide recess 92A of the first rotary contact pin 9A and the guide recess 101A of the first stationary contact pin 10A. The first spring 12A abutting the rear end of the first linking pin 11A is mounted in the guide recess 92A of the first rotary contact pin 9A.

Figure 3:
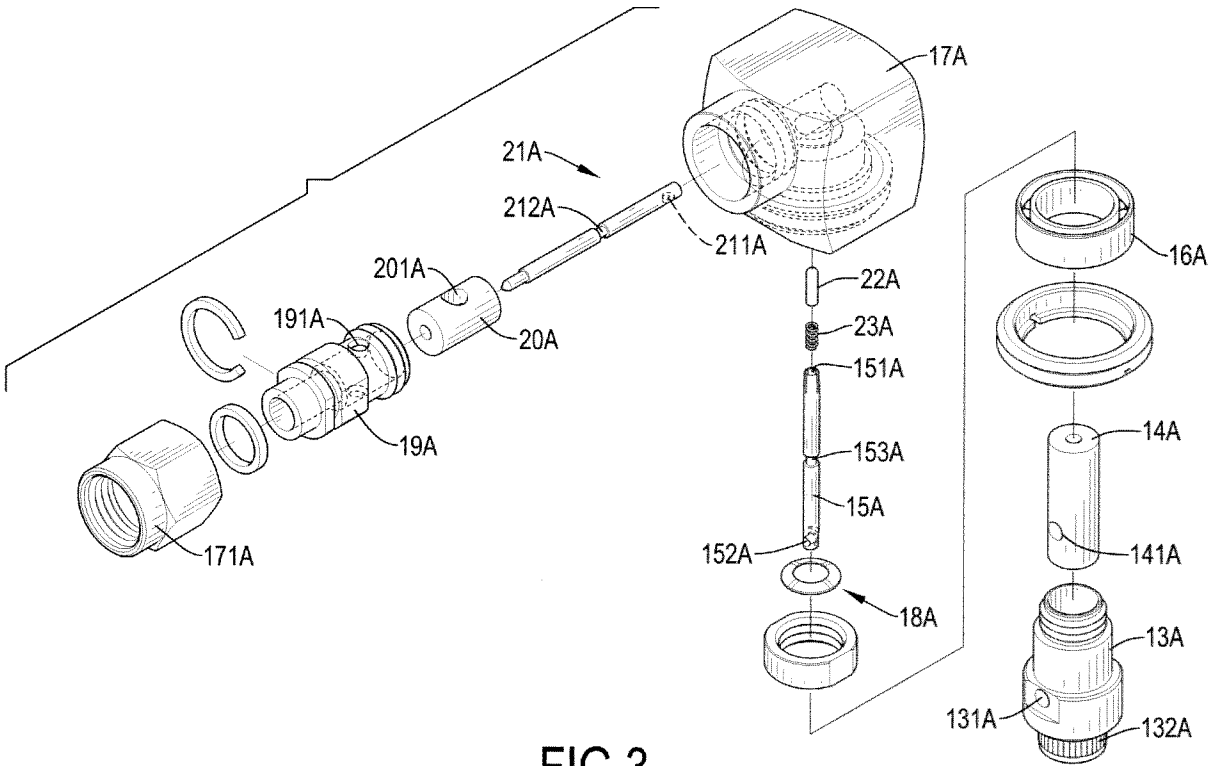
FIG. 3 is an exploded perspective view of a second assembly of the rotatable coaxial adaptor in FIG. 1.

With further reference to FIG. 3, the second stationary part which has a connecting sleeve 13A and a second stationary insulator 14A is connected to the first mounting block 1A. The connecting sleeve 13A with an annular sidewall, a top end, a bottom end, two pouring holes 131A and an embossed surface 132A is secured to the first mounting block 1A. The pouring holes 131A are respectively formed through the annual sidewall of the connecting sleeve 13A. The embossed surface 132A is formed around the bottom end of the connecting sleeve 13A and is inserted into the top opening of the first mounting block 1A. The second stationary insulator 14A with an annular sidewall and two pouring holes 141A is mounted in the connecting sleeve 13A. The pouring holes 141A are respectively formed through the annual sidewall of the connecting sleeve 13A and align with the pouring holes 131A of the connecting sleeve 13A.

the second stationary contact pin 15A with a top end surface, a bottom end, an annular surface, a guide recess 151A, an inserting hole 152A and an annular groove 153A is made of an electrically conductive material, is mounted through the second stationary insulator 14A and is connected to the first stationary contact pin 10A. The guide recess 151A is formed in the top end surface of the second stationary contact pin 15A. The inserting hole 152A is formed through the bottom end of the second stationary contact pin 15A and the inserting rod 102A of the first stationary contact pin 10A is inserted into the inserting hole 152A. The annular groove 153A is formed in the annular surface of the second stationary contact pin 15A and communicates with the pouring holes 141A of the second stationary insulator 14A. The second bearing 16A is mounted around the connecting sleeve 13A.

The second mounting block 17A is rotatably mounted around the second bearing 16A so that the second mounting block 17A can rotate relative to the connecting sleeve 13A. The second mounting block 17A has a second receiving space, a bottom surface, a bottom opening and a second joining tube 171A. The second receiving space is formed inside the second mounting block 17A and has an open front. The bottom opening is formed in the bottom surface of the second mounting block 17A and communicates with the second receiving space. The top end of the connecting sleeve 13A and the second bearing 16A are received in the bottom opening. A second wave spring 18A is mounted between the top end of the connecting sleeve 13A and an bottom end surface of the second mounting block 17A for reducing friction damage while the second mounting block 17A rotates relative to the connecting sleeve 13A. The second joining tube 171A is formed on the open front of the second receiving space.

The second rotary part is mounted in the second joining tube 171A and the second receiving space of the second mounting block 17A and has a second rotary sleeve 19A and a second rotary insulator 20A. The second rotary sleeve 19A with an annular sidewall and two pouring holes 191A is secured in the second receiving space of the second mounting block 17A. The pouring holes 191A are respectively formed through the annual sidewall of the second rotary sleeve 19A. The second rotary insulator 20A with an annular sidewall and two pouring holes 201A is mounted in the second rotary sleeve 19A. The pouring holes 201A are respectively formed through the annual sidewall of the second rotary insulator 20A and align with the pouring holes 191A of the second rotary sleeve 19A.

The second rotary contact pin 21A with a rear end, an annular surface, a guide recess 211A and an annular groove 212A is made of an electrically conductive material, is mounted through the second rotary insulator 20A and is rotatably connected to the second stationary contact pin 15A. The guide recess 211A is formed in the rear end of the second rotary contact pin 21A. The annular groove 212A is formed in the annular surface of the second rotary contact pin 21A and communicates with the pouring holes 201A of the second rotary insulator 20A.

The second linking pin 22A with a top end and a bottom end is made of an electrically conductive material and respectively mounted in the guide recess 211A of the second rotary contact pin 21A and the guide recess 151A of the second stationary contact pin 15A. The second spring 23A abutting the bottom end of the second linking pin 22A is mounted in the guide recess 151A of the second stationary contact pin 15A.

An adhesive is poured into the pouring holes 41A, 51A, 131A, 191A of the sleeves 4A, 5A, 13A, 19A so as to glue the corresponding sleeve, insulator and contact pin together. Preferably, the adhesive is two-component adhesive hardened by mixing two components which chemically react. Further, a silver adhesive is used to seal the pouring holes 131A of the connecting sleeve 13A to prevent signal leakage.

When the rotatable coaxial adaptor in accordance with the present invention is in use, the connecting section 31A of the first joining tube 3A and the first rotary contact pin 9A are connected to a coaxial connector of a coaxial cable and the second joining tube 171A and the second rotary contact pin 21A are connected to another coaxial connector of another coaxial cable. The first bearing 2A allows the first joining tube 3A, the first rotary sleeve 4A, the first rotary insulator 7A and the first rotary contact pin 9A to rotate relative to the first mounting block 1A. The second bearing 16A allows the second mounting block 17A, the second rotary sleeve 19A, the second rotary insulator 20A and the second rotary contact pin 21A to rotate relative to the connecting sleeve 13A and the first mounting block 1A. Consequently, when devices connected to the coaxial cables are moved, the coaxial cable will not be driven to bend. The coaxial cable can be protected from damage and the lifespan thereof can be prolonged.

Even though numerous characteristics and advantages of the present invention have been set forth in the foregoing description, together with details of the structure and features of the invention, the disclosure is illustrative only. Changes may be made in the details, especially in matters of shape, size and arrangement of parts within the principles of the invention to the full extent indicated by the broad general meaning of the terms in which the appended claims are expressed.

What is claimed is:

1. A rotatable coaxial adaptor for linking high frequency coaxial cables comprising:

a first mounting block including a first receiving space formed inside the first mounting block and having an open rear;

a top surface; and a top opening formed in the top surface of the first mounting block and communicating with the first receiving space;

a first stationary insulator mounted in the first receiving space of the first mounting block;

a first stationary contact pin made of an electrically conductive material and mounted through the first stationary insulator;

a first bearing mounted in the first receiving space of the first mounting block;

a first rotary part rotatably mounted through the first bearing and including a first rotary insulator and a first joining tube;

a first rotary contact pin made of an electrically conductive material, mounted through the first rotary insulator, rotatably connected to the first stationary contact pin and including a rear end surface; and a contact recess formed in the rear end surface of the first rotary contact pin;

a connecting sleeve secured to the top opening of the first mounting block at a bottom end;

a second stationary insulator mounted in the connecting sleeve;

a second stationary contact pin made of an electrically conductive material, mounted through the second stationary insulator and connected to the first stationary contact pin;

a second bearing mounted around the connecting sleeve;

a second mounting block rotatably mounted around the second bearing and including a second receiving space formed inside the second mounting block and having an open front;

a bottom surface;

a bottom opening formed in the bottom surface of the second mounting block and communicating with the second receiving space, and a top end of the connecting sleeve and the second bearing received in the bottom opening; and a second joining tube formed on the open front of the second receiving space;

a second rotary insulator mounted in the second receiving space of the second mounting block; and a second rotary contact pin made of an electrically conductive material, mounted through the second rotary insulator and rotatably connected to the second stationary contact pin.

2. The rotatable coaxial adaptor as claimed in claim 1, wherein the second stationary contact pin includes an inserting hole formed through a bottom end thereof; and the first stationary contact pin includes an inserting rod extending from a front end surface thereof and inserted into the inserting hole of the second stationary contact pin.

3. The rotatable coaxial adaptor as claimed in claim 1, wherein the first rotary part further includes a first rotary sleeve rotatably mounted through the first bearing;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube; and the rotatable coaxial adaptor further comprises a stationary sleeve disposed in the first receiving space of the first mounting block and mounted around the first stationary insulator; and a second rotary sleeve secured in the second receiving space of the second mounting block and mounted around the second rotary insulator.

4. The rotatable coaxial adaptor as claimed in claim 3 further including a first wave spring mounted between the first rotary sleeve and the stationary sleeve; and a second wave spring mounted between the top end of the connecting sleeve and the second mounting block.

5. The rotatable coaxial adaptor as claimed in claim 1, wherein the first rotary insulator, the first stationary insulator, the second stationary insulator and the second rotary insulator respectively include at least one pouring hole;

the first rotary contact pin includes an annular groove formed in an annular surface thereof and communicating with at least one pouring hole of the first rotary insulator;

the first stationary contact pin includes an annular groove formed in an annular surface thereof and communicating with at least one pouring hole of the first stationary insulator;

the second stationary contact pin includes an annular groove formed in an annular surface thereof and communicating with at least one pouring hole of the second stationary insulator;

the second rotary contact pin includes an annular groove formed in an annular surface thereof and communicating with at least one pouring hole of the second rotary insulator; and an adhesive is poured into the pouring holes of the first rotary insulator, the first stationary insulator, the second stationary insulator and the second rotary insulator and the annular grooves of the first rotary contact pin, the first stationary contact pin, the second stationary contact pin and the second rotary contact pin.

6. The rotatable coaxial adaptor as claimed in claim 5, wherein the first rotary part further includes a first rotary sleeve rotatably mounted through the first bearing and having at least one pouring hole aligning with at least one pouring hole of the first rotary insulator;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube;

the connecting sleeve includes at least one pouring hole aligning with at least one pouring hole of the second stationary insulator;

the rotatable coaxial adaptor further comprises a stationary sleeve which is disposed in the first receiving space of the first mounting block and mounted around the first stationary insulator includes at least one pouring hole aligning with at least one pouring hole of the first stationary insulator; and a second rotary sleeve which is secured in the second receiving space of the second mounting block and mounted around the second rotary insulator includes at least one pouring hole aligning with at least one pouring hole of the second rotary insulator; and the adhesive is poured into the pouring holes of the first rotary sleeve, the connecting sleeve, the stationary sleeve and the second rotary sleeve.

7. The rotatable coaxial adaptor as claimed in claim 6 further including a first wave spring mounted between the first rotary sleeve and the stationary sleeve; and a second wave spring mounted between the top end of the connecting sleeve and the second mounting block.

8. The rotatable coaxial adaptor as claimed in claim 6, wherein the second stationary contact pin includes an inserting hole formed through a bottom end thereof; and the first stationary contact pin includes an inserting rod extending from a front end surface thereof and inserted into the inserting hole of the second stationary contact pin.

9. The rotatable coaxial adaptor as claimed in claim 1, wherein the first rotary contact pin includes a guide recess formed in a front end surface thereof;

the first stationary contact pin includes a guide recess formed in a rear end surface thereof;

the second stationary contact pin includes a guide recess formed in a top end surface thereof;

the second rotary contact pin includes a guide recess formed in a rear end thereof; and the rotatable coaxial adaptor further comprises a first linking pin made of an electrically conductive material and including a rear end and a front end respectively mounted in the guide recess of the first rotary contact pin and the guide recess of the first stationary contact pin; and a second linking pin made of an electrically conductive material and including a top end and a bottom end respectively mounted in the guide recess of the second rotary contact pin and the guide recess of the second stationary contact pin.

10. The rotatable coaxial adaptor as claimed in claim 9 further comprising a first spring abutting the rear end of the first linking pin and mounted in the guide recess of the first rotary contact pin; and a second spring abutting the bottom end of the second linking pin and mounted in the guide recess of the second stationary contact pin.

11. The rotatable coaxial adaptor as claimed in claim 10, wherein the first rotary insulator, the first stationary insulator, the second stationary insulator and the second rotary insulator respectively include at least one pouring hole;

the first rotary contact pin includes an annular groove formed in an annular surface thereof and communicating with at least one pouring hole of the first rotary insulator;

the first stationary contact pin includes an annular groove formed in an annular surface thereof and communicating with at least one pouring hole of the first stationary insulator;

the second stationary contact pin includes an annular groove formed in an annular surface thereof and communicating with at least one pouring hole of the second stationary insulator;

the second rotary contact pin includes an annular groove formed in an annular surface thereof and communicating with at least one pouring hole of the second rotary insulator; and an adhesive is poured into the pouring holes of the first rotary insulator, the first stationary insulator, the second stationary insulator and the second rotary insulator and the annular grooves of the first rotary contact pin, the first stationary contact pin, the second stationary contact pin and the second rotary contact pin.

12. The rotatable coaxial adaptor as claimed in claim 11, wherein the first rotary part further includes a first rotary sleeve rotatably mounted through the first bearing and having at least one pouring hole aligning with at least one pouring hole of the first rotary insulator;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube;

the connecting sleeve includes at least one pouring hole aligning with at least one pouring hole of the second stationary insulator;

the rotatable coaxial adaptor further comprises a stationary sleeve which is disposed in the first receiving space of the first mounting block and mounted around the first stationary insulator includes at least one pouring hole aligning with at least one pouring hole of the first stationary insulator; and a second rotary sleeve which is secured in the second receiving space of the second mounting block and mounted around the second rotary insulator includes at least one pouring hole aligning with at least one pouring hole of the second rotary insulator; and the adhesive is poured into the pouring holes of the first rotary sleeve, the connecting sleeve, the stationary sleeve and the second rotary sleeve.

13. The rotatable coaxial adaptor as claimed in claim 10, wherein the first rotary part further includes a first rotary sleeve rotatably mounted through the first bearing;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube; and the rotatable coaxial adaptor further comprises a stationary sleeve disposed in the first receiving space of the first mounting block and mounted around the first stationary insulator; and a second rotary sleeve secured in the second receiving space of the second mounting block and mounted around the second rotary insulator.

14. The rotatable coaxial adaptor as claimed in claim 13 further including a first wave spring mounted between the first rotary sleeve and the stationary sleeve; and a second wave spring mounted between the top end of the connecting sleeve and the second mounting block.

15. The rotatable coaxial adaptor as claimed in claim 10, wherein the second stationary contact pin includes an inserting hole formed through a bottom end thereof; and the first stationary contact pin includes an inserting rod extending from a front end surface thereof and inserted into the inserting hole of the second stationary contact pin.

16. The rotatable coaxial adaptor as claimed in claim 9, wherein the first rotary insulator, the first stationary insulator, the second stationary insulator and the second rotary insulator respectively include at least one pouring hole;

the first rotary contact pin includes an annular groove formed in an annular surface thereof and communicating with at least one pouring hole of the first rotary insulator;

the first stationary contact pin includes an annular groove formed in an annular surface thereof and communicating with at least one pouring hole of the first stationary insulator;

the second stationary contact pin includes an annular groove formed in an annular surface thereof and communicating with at least one pouring hole of the second stationary insulator;

the second rotary contact pin includes an annular groove formed in an annular surface thereof and communicating with at least one pouring hole of the second rotary insulator; and an adhesive is poured into the pouring holes of the first rotary insulator, the first stationary insulator, the second stationary insulator and the second rotary insulator and the annular grooves of the first rotary contact pin, the first stationary contact pin, the second stationary contact pin and the second rotary contact pin.

17. The rotatable coaxial adaptor as claimed in claim 16, wherein the first rotary part further includes a first rotary sleeve rotatably mounted through the first bearing and having at least one pouring hole aligning with at least one pouring hole of the first rotary insulator;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube;

the connecting sleeve includes at least one pouring hole aligning with at least one pouring hole of the second stationary insulator;

the rotatable coaxial adaptor further comprises a stationary sleeve which is disposed in the first receiving space of the first mounting block and mounted around the first stationary insulator includes at least one pouring hole aligning with at least one pouring hole of the first stationary insulator; and a second rotary sleeve which is secured in the second receiving space of the second mounting block and mounted around the second rotary insulator includes at least one pouring hole aligning with at least one pouring hole of the second rotary insulator; and the adhesive is poured into the pouring holes of the first rotary sleeve, the connecting sleeve, the stationary sleeve and the second rotary sleeve.

18. The rotatable coaxial adaptor as claimed in claim 9, wherein the first rotary part further includes a first rotary sleeve rotatably mounted through the first bearing;

the first joining tube is secured around the first rotary sleeve and has a connecting section formed on a rear end thereof and protruding out of the open rear of the first receiving space of the first mounting block;

the first rotary insulator is mounted through the first rotary sleeve and the first joining tube; and the rotatable coaxial adaptor further comprises a stationary sleeve disposed in the first receiving space of the first mounting block and mounted around the first stationary insulator; and a second rotary sleeve secured in the second receiving space of the second mounting block and mounted around the second rotary insulator.

19. The rotatable coaxial adaptor as claimed in claim 18 further including a first wave spring mounted between the first rotary sleeve and the stationary sleeve; and a second wave spring mounted between the top end of the connecting sleeve and the second mounting block.

20. The rotatable coaxial adaptor as claimed in claim 9, wherein the second stationary contact pin includes an inserting hole formed through a bottom end thereof; and the first stationary contact pin includes an inserting rod extending from a front end surface thereof and inserted into the inserting hole of the second stationary contact pin.

* * * * *